US008188825B2

(12) United States Patent
Liu et al.

(10) Patent No.: US 8,188,825 B2
(45) Date of Patent: May 29, 2012

(54) TRANSFORMER STRUCTURE

(75) Inventors: Choa-Ming Liu, Taoyuan Hsien (TW); Chih-Ming Chen, Taoyuan Hsien (TW); Yu-Chun Lai, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/625,001

(22) Filed: Nov. 24, 2009

(65) Prior Publication Data

US 2010/0289607 A1 Nov. 18, 2010

(30) Foreign Application Priority Data

May 15, 2009 (TW) ..... 98116245 A

(51) Int. Cl.
*H01F 27/30* (2006.01)
*H01F 27/06* (2006.01)
*H01F 17/06* (2006.01)
*H01F 27/28* (2006.01)

(52) U.S. Cl. ..... 336/198; 336/65; 336/178; 336/180; 336/208

(58) Field of Classification Search ..... 336/65, 336/178, 180, 198, 208
See application file for complete search history.

(56) References Cited

U.S. PATENT DOCUMENTS 4,887,061 A * 12/1989 Matsumura ..... 336/178
4,931,761 A * 6/1990 Kijima ..... 336/160
2006/0181384 A1* 8/2006 Hsueh et al. ..... 336/122
2008/0068118 A1* 3/2008 Ushijima et al. ..... 336/90

FOREIGN PATENT DOCUMENTS

JP 06237393 A * 8/1994

* cited by examiner

*Primary Examiner* — Elvin G Enad
*Assistant Examiner* — Tsz Chan
(74) *Attorney, Agent, or Firm* — Kirton McConkie; Evan R. Witt

(57) ABSTRACT

A transformer includes a base, a magnetic core assembly and at least one winding coil assembly. The base includes a first receptacle and at least one first receiving recess. The magnetic core assembly includes a first magnetic part, a second magnetic part and a third magnetic part. The base is arranged between the first magnetic part and the second magnetic part. The first magnetic part has a first post accommodated within the first receptacle. The at least one winding coil assembly is disposed on the base. The third magnetic part is optionally accommodated within the first receiving recess, so that an air gap between the third magnetic part and the first magnetic part/the second magnetic part is adjustable.

12 Claims, 7 Drawing Sheets

TRANSFORMER STRUCTURE

FIELD OF THE INVENTION

The present invention relates to a transformer structure, and more particularly to a transformer structure having an adjustable air gap.

BACKGROUND OF THE INVENTION

Nowadays, magnetic elements such as inductors and transformers are widely used in many electronic devices to generate induced magnetic fluxes. Recently, since the electronic devices are developed toward minimization, the electronic components contained in the electronic products become small in size and light in weight. Therefore, the magnetic element and its conductive winding module are slim.

Take a transformer for example. FIG. 1A is a schematic exploded view of a conventional transformer. The transformer 1 comprises a bobbin 11, a magnetic core assembly 12 and a coil 13. The bobbin 11 has a winding section 111 for winding the coil 13 thereon. The bobbin 11 further has a channel 112 running through a center portion thereof. In addition, the bobbin 11 has several pins 113 extended from the bottom surface thereof and connected to the coil 13. By soldering the pins 113 on a circuit board (not shown), the transformer 1 is mounted on and electrically connected to the circuit board. The magnetic core assembly 12 includes a first magnetic part 121 and a second magnetic part 122. The first magnetic part 121 has a middle post 121*a* and two lateral posts 121*b*. The second magnetic part 122 also has a middle post 122*a* and two lateral posts 122*b*. As such, the first magnetic part 121 and the second magnetic part 122 of the magnetic core assembly 12 are cooperatively formed as an EE-type core assembly.

For assembling the transformer 1, the middle post 121*a* of the first magnetic part 121 and the middle post 122*a* of the second magnetic part 122 are aligned with and embedded into the channel 112. In addition, the lateral posts 121*b* of the first magnetic part 121 are contacted with the lateral posts 122*b* of the second magnetic part 122. As such, the coils 13 will interact with the magnetic core assembly 12 to achieve the purpose of voltage regulation. The resulting structure of the assembled transformer 1 is schematically shown in FIG. 1B.

When the conventional transformer 1 is applied to a power factor correction (PFC) circuit, the distance between the middle post 121*a* of the first magnetic part 121 and the middle post 122*a* of the second magnetic part 122 should be adjusted such that the air gap of the transformer 1 is changed. As the air gap of the transformer 1 is changed, the inductance of the transformer 1 could be controlled.

For achieving the purpose, portions of the middle posts 121*a* and 122*a* are scraped by a tool such that middle post 121*a*/122*a* is shorter than the lateral post 122*a*/122*b* by $d_0$ (as shown in FIG. 1A). Under this circumstance, after the middle post 121*a* of the first magnetic part 121 and the middle post 122*a* of the second magnetic part 122 are embedded into the channel 112, the middle post 121*a* is distant from the middle post 122*a* by an air gap of $2\times d_0$. Due to the air gap, the inductance of the transformer 1 is adjusted.

The process of fabricating the transformer 1 has some drawbacks. For example, since the lateral posts 122*a* and 122*b* are disposed at bilateral sides of the middle posts 121*a* and 122*a*, the lateral posts 122*a* and 122*b* become hindrance from scraping the middle posts 121*a* and 122*a*. Especially when a longer air gap is required, the process of scraping the middle posts 121*a* and 122*a* is time consuming and complicated.

Moreover, the air gap of the conventional transformer 1 is fixed. For changing the air gap of the transformer 1, a new magnetic core assembly is provided and portions of the middle posts 121*a* and 122*a* are scraped. In other words, the original magnetic parts 121 and 122 will be discarded and thus the fabricating cost is increased. In addition, discarding the original magnetic parts 121 and 122 is not environmentally-friendly. The process of scraping the magnetic core assembly results in much core powder, which also incurs pollution. Since the magnetic core assembly is usually scraped by a grinding wheel, the internal portion of the magnetic core assembly is possibly damaged to some extents and the performance of the transformer 1 is deteriorated.

Since the middle post 121*a* is distant from the middle post 122*a* by an air gap of $2\times d_0$, an edge effect is generated. Under this circumstance, the eddy loss is increased, and the operating temperature of the transformer 1 is increased. An additional heat-dissipating mechanism increases the overall cost.

Therefore, there is a need of providing an improved transformer so as to obviate the drawbacks encountered from the prior art.

SUMMARY OF THE INVENTION

It is an object of the present invention to provide a transformer having increased air gap between two middle posts of the magnetic core assembly so as to adjust the inductance.

Another object of the present invention provides a transformer having reduced volume and produced in a simplified process, thereby reducing the fabricating cost and time.

A further object of the present invention provides a transformer having an adjustable air gap, so that the eddy loss and the operating temperature are reduced.

In accordance with an aspect of the present invention, there is provided a transformer. The transformer includes a base, a magnetic core assembly and at least one winding coil assembly. The base includes a first receptacle and at least one first receiving recess. The magnetic core assembly includes a first magnetic part, a second magnetic part and a third magnetic part. The base is arranged between the first magnetic part and the second magnetic part. The first magnetic part has a first post accommodated within the first receptacle and inserted into the first receptacle in a first direction. The at least one winding coil assembly is disposed on the base. The third magnetic part is optionally accommodated within the first receiving recess and aligned with the first post of the first magnetic part, so that an air gap between the third magnetic part and the first magnetic part/the second magnetic part is adjustable in a direction parallel to the first direction.

In accordance with another aspect of the present invention, there is provided a transformer. The transformer includes a base, a magnetic core assembly and at least one winding coil assembly. The base includes a first receptacle and multiple first receiving recesses, wherein the first receiving recesses are distributed in different locations of the base. The magnetic core assembly includes a first magnetic part, a second magnetic part and multiple third magnetic parts. The base is arranged between the first magnetic part and the second magnetic part. The first magnetic part has a first post accommodated within the first receptacle and inserted into the first receptacle in a first direction. The at least one winding coil assembly is disposed on the base. At least one of the third magnetic parts is optionally accommodated within a respective first receiving recess and aligned with the first post of the first magnetic part, so that an air gap between the third magnetic part and the first magnetic part/the second magnetic part is adjustable in a direction parallel to said first direction.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
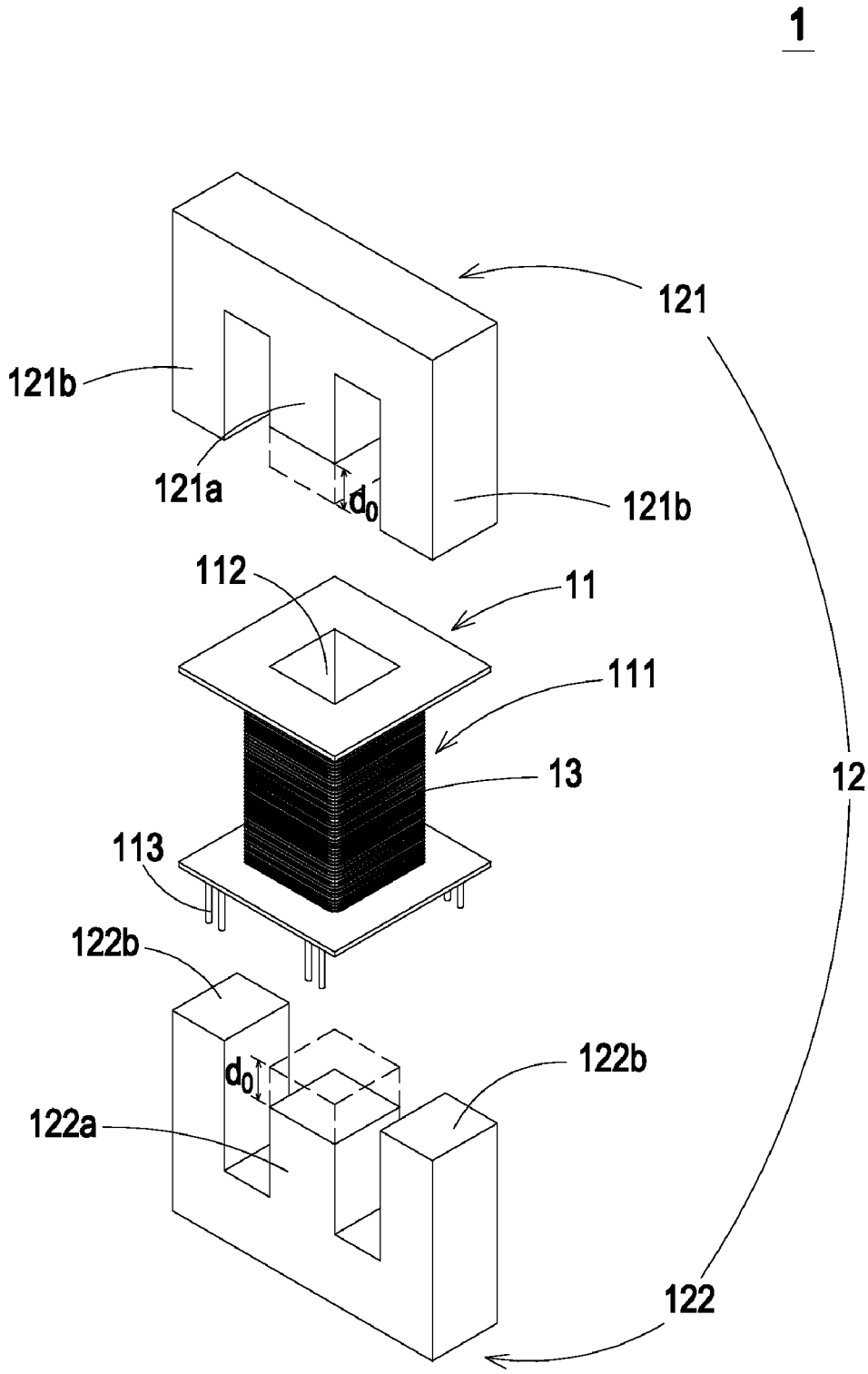
FIG. 1A PRIOR ART
FIG. 1A is a schematic exploded view of a conventional transformer.
Figure 1B:
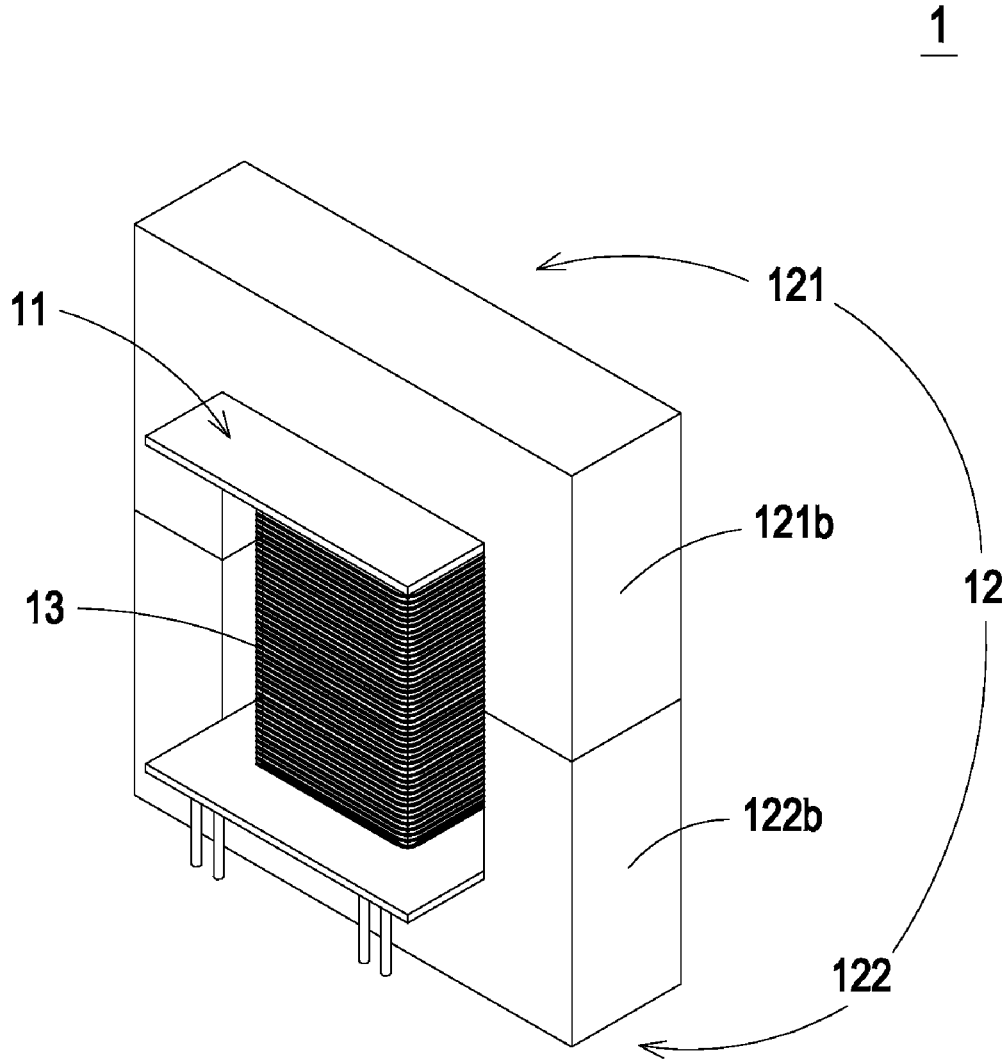
FIG. 1B PRIOR ART
FIG. 1B is a schematic assembled view of a conventional transformer.
Figure 2A:
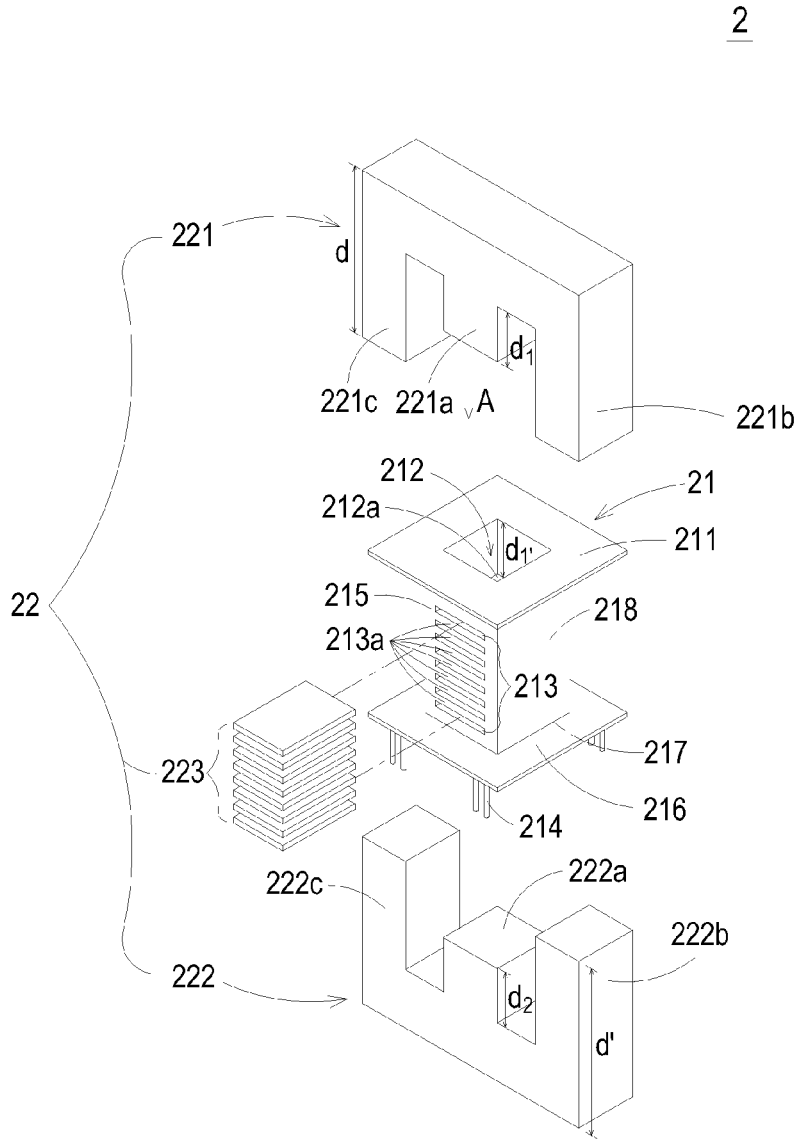
FIG. 2A is a schematic exploded view of a transformer according to a first embodiment of the present invention, in which the winding coil assembly is not shown.
Figure 2B:
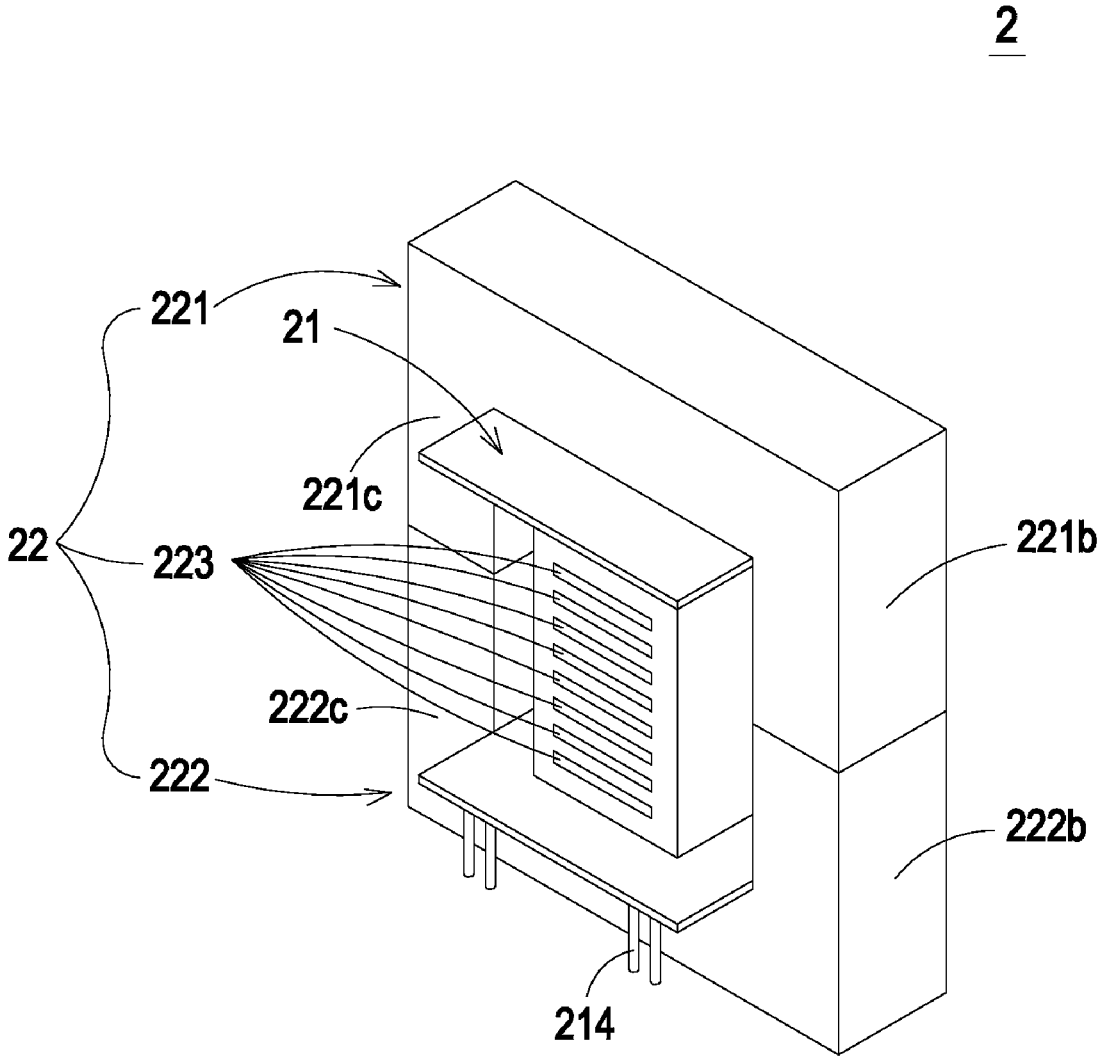
FIG. 2B is a schematic assembled view of the transformer as shown in FIG. 2A.

FIG. 2A is a schematic exploded view of a transformer according to a first embodiment of the present invention, in which the winding coil assembly is not shown. FIG. 2B is a schematic assembled view of the transformer as shown in FIG. 2A. As shown in FIGS. 2A and 2B, the transformer 2 comprises a base 21, a magnetic core assembly 22 and at least one winding coil assembly 23 (see FIG. 2C). The base 21 comprises a first receptacle 212 and multiple first receiving recesses 213. The magnetic core assembly 22 comprises a first magnetic part 221, a second magnetic part 222 and a third magnetic part 223. The first magnetic part 221 has a first post to be inserted into the first receptacle 212 in a first direction (shown as arrow A). In this embodiment, the first post is the middle post 221*a* of the first magnetic part 221. The third magnetic part 223 is optionally embedded into corresponding first receiving recess 213 and aligned with the middle post 221*a* of the first magnetic part 221. The winding coil assembly 23 is disposed on the base 21 (see FIG. 2C).

In this embodiment, the base 21 is a rectangular sleeve. The first receptacle 212 is formed in a first surface 211 of the base 21. The multiple first receiving recesses 213 are formed in a second surface 215 of the base 21. The first surface 211 is substantially perpendicular to the second surface 215. In some embodiments, a second receptacle 217 is formed in a third surface 216 of the base 21, wherein the third surface 216 is parallel to the first surface 211. In addition, the base 21 has several pins 214 extended downwardly from the third surface 216. By soldering the pins 214 on a circuit board (not shown), the transformer 2 is mounted on and electrically connected to the circuit board.

Please refer to FIG. 2A. The magnetic core assembly 22 comprises the first magnetic part 221, the second magnetic part 222 and the third magnetic part 223. The first magnetic part 221 has a first post. The first post is integrally formed with the first magnetic part 221. The first post and the first receptacle 212 have complementary shapes. In this embodiment, the first post is a first middle post 221*a* of the first magnetic part 221. In this embodiment, the length $d_1$ of the first middle post 221*a* is substantially equal to the depth $d_1'$ of the first receptacle 212. The length $d_1$ of the first middle post 221*a* is smaller than the length d of each of the lateral posts 221*b* and 221*c* of the first magnetic part 221. In this embodiment, the second magnetic part 222 has a second post. The second post is integrally formed with second magnetic part 222. The second post is accommodated within the second receptacle 217 of the base 21. In this embodiment, the second post is a second middle post 222*a* of the second magnetic part 222. The length $d_2$ of the second middle post 222*a* is substantially equal to the depth of the second receptacle 217. The length $d_1$ of the second middle post 222*a* is smaller than the length d' of each of the lateral posts 222*b* and 222*c* of the second magnetic part 222. As such, the second middle post 222*a* could be tightly accommodated within the second receptacle 217 of the base 21. The length d' of each of the lateral posts 222*b* and 222*c* of the second magnetic part 222 is equal to the length d of each of the lateral posts 221*b* and 221*c* of the first magnetic part 221. In this embodiment, the first receptacle 212 is separated from a neighboring first receiving recess 213 by a first partition plate 212*a*. In a case that the base 21 has multiple first receiving recesses 213, every two adjacent first receiving recesses 213 are separated from each other by a partition plate 213*a*. The second receptacle 217 is separated from a neighboring first receiving recess 213 by a second partition plate (not shown).

In this embodiment, the magnetic core assembly 22 is an EE-type core assembly. Alternatively, the magnetic core assembly 22 could be a UU-type core assembly or an EI-type core assembly according to the practical requirements. The magnetic core assembly 22 further comprises multiple third magnetic parts 223. The third magnetic parts 223 are slab-type cores. The dimension of the third magnetic part 223 is identical to the dimension of a corresponding first receiving recess 213 of the base 21. For example, if the first receiving recess 213 is a rectangular recess, the third magnetic part 223 is a rectangular slab-type core in order to be accommodated within the first receiving recess 213. If the first receiving recess 213 is a circular recess, third magnetic part 223 is a circular slab-type core in order to be accommodated within the first receiving recess 213. The number of the third magnetic parts 223 could be varied according to the practical requirements. In some embodiments, the magnetic core assembly has a single third magnetic part 223, and the third magnetic part 223 is accommodated into either of the first receiving recess 213 and aligned with the first middle post 221*a* of the first magnetic part 221. As a consequence, the distance between the third magnetic part 223 and the first magnetic part 221 and the distance between the third magnetic part 223 and the second magnetic part 222 are adjustable in a direction parallel to the first direction. Due to the air gap, the inductance of the transformer 2 could be adjusted.

Figure 2C:
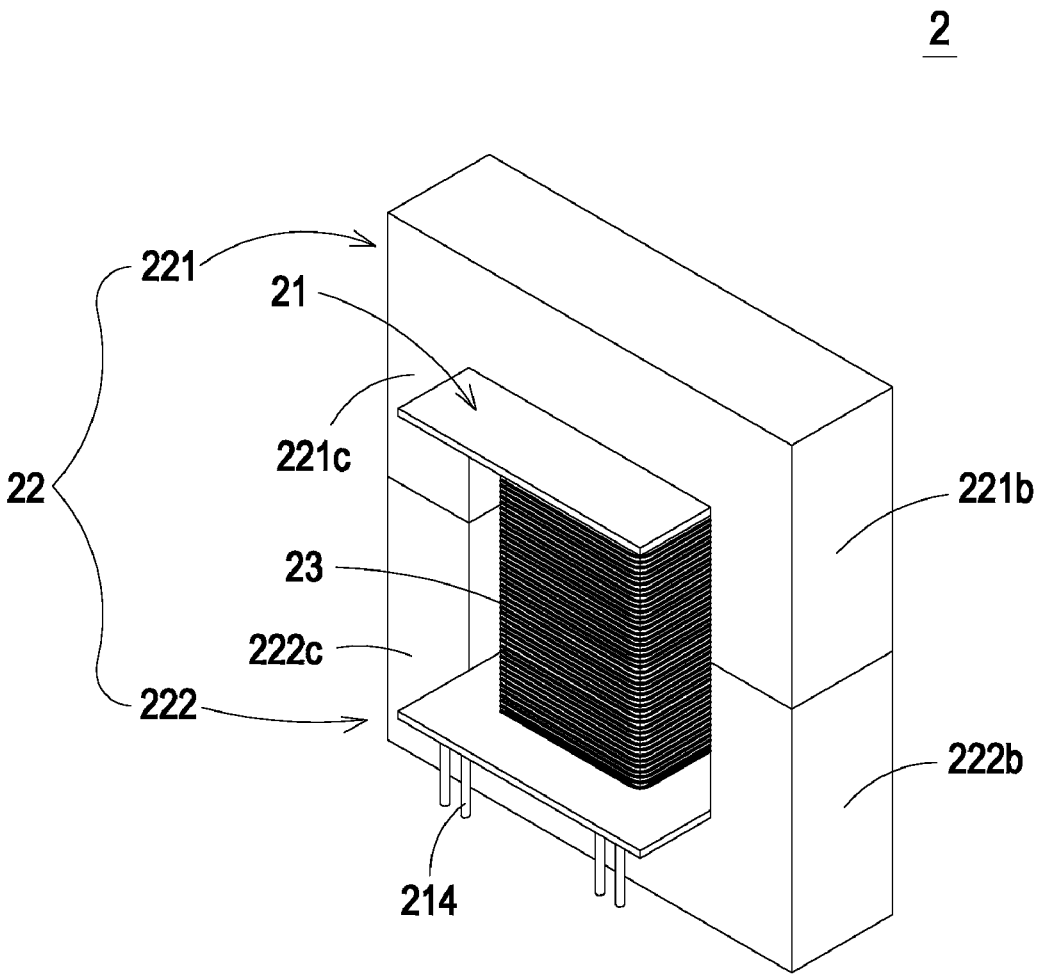
FIG. 2C is a schematic assembled view of the transformer according to the first embodiment, in which the winding coil assembly is included.

FIG. 2C is a schematic assembled view of the transformer according to the first embodiment, in which the winding coil assembly is included. Hereinafter, a process for assembling the transformer 2 will be illustrated with reference to FIGS. 2A, 2B and 2C. First of all, the third magnetic parts 223 are accommodated within respective first receiving recesses 213 and aligned with the first middle post 221*a* of the first magnetic part 221. Then, the third magnetic parts 223 are fixed within respective first receiving recesses 213 by winding insulating tapes or applying solder paste. Then, the winding coil assembly 23 is wound around the base 21. Then, the base 21 is arranged between the first magnetic part 221 and the second magnetic part 222. In this embodiment, the winding coil assembly 23 includes a primary winding coil and a secondary winding coil. In some embodiments, the winding coil assembly 23 comprises at least one flat copper sheet. Several second receiving recesses (not shown) are formed in a fourth surface 218 of the base 21 for accommodating multiple flat copper sheets of the winding coil assembly 23. As such, the winding coil assembly 23 will interact with the magnetic core assembly 22 to achieve the purpose of voltage regulation. Alternatively, the winding coil assembly 23 is a coil pancake by winding a conductive wire. Alternatively, the winding coil assembly 23 is made of copper foil. In some embodiments, some of the second receiving recesses (not shown) in the fourth surface 218 are used for accommodating corresponding third magnetic parts 223. That is, some of the third magnetic parts 223 are accommodated within the first receiving recesses 213 and the remaindering third magnetic parts 223 are accommodated within the second receiving recesses. In some embodiments, the fourth surface 218 is substantially perpendicular to the first surface 211. In addition, the fourth surface 218 is parallel with the second surface 215 or next to the second surface 215. The locations of the second receiving recesses could be varied according to the practical requirements.

Next, the first middle post 221*a* of the first magnetic part 221 and the second middle post 222*a* of the second magnetic part 222 are aligned with and embedded into the first receptacle 212 and the second receptacle 217 of the base 21, respectively. At the same time, the lateral posts 221*b* and 221*c* of the first magnetic part 221 are respectively contacted with the lateral posts 222*b* and 222*c* of the second magnetic part 222. Next, the first magnetic part 221 is fixed on the second magnetic part 222 by an insulating tape or a clamping tool (not shown), thereby assembling the transformer 2 as shown in FIG. 2C. The winding coil assembly 23 will interact with the first magnetic part 221, the second magnetic part 222 and the third magnetic parts 223 to achieve the purpose of voltage regulation. The number of the third magnetic parts 223 could be varied according to the practical requirements. According to the number of the third magnetic parts and the distribution of the third magnetic parts, the air gap of the magnetic core assembly 22 of the transformer 2 is adjustable. After the third magnetic parts 223 are accommodated with respective first receiving recesses 213 of the base 21, the thickness of the transformer is substantially equal to the sum of the height d of the first magnetic part 221 and the height d' of the second magnetic part 222. That is, the overall volume of the transformer 2 is reduced.

Moreover, the first middle post 221*a* of the first magnetic part 221 and the second middle post 222*a* of the second magnetic part 222, and the third magnetic parts 223 could be predetermined and produced by a molding process. For adjusting the air gap of the transformer 2, only the number and the relative locations of the third magnetic parts 223 need to be changed. Since the magnetic core assembly is standardized, the fabricating process of the transformer is simplified and the fabricating cost is reduced. In other words, the conventional process of scraping the first magnetic part and the second magnetic part will be exempted. Under this circumstance, the possibility of damaging the magnetic core assembly is minimized and the performance and yield of the transformer are enhanced.

Moreover, by changing the number and/or the location of the third magnetic part, the air gap between the third magnetic part and the first magnetic part/the second magnetic part is adjustable. As a consequence, the eddy loss and the operating temperature are reduced. Under this circumstance, no additional heat-dissipating mechanism is required and thus the application of the transformer is broadened.

Figure 3:
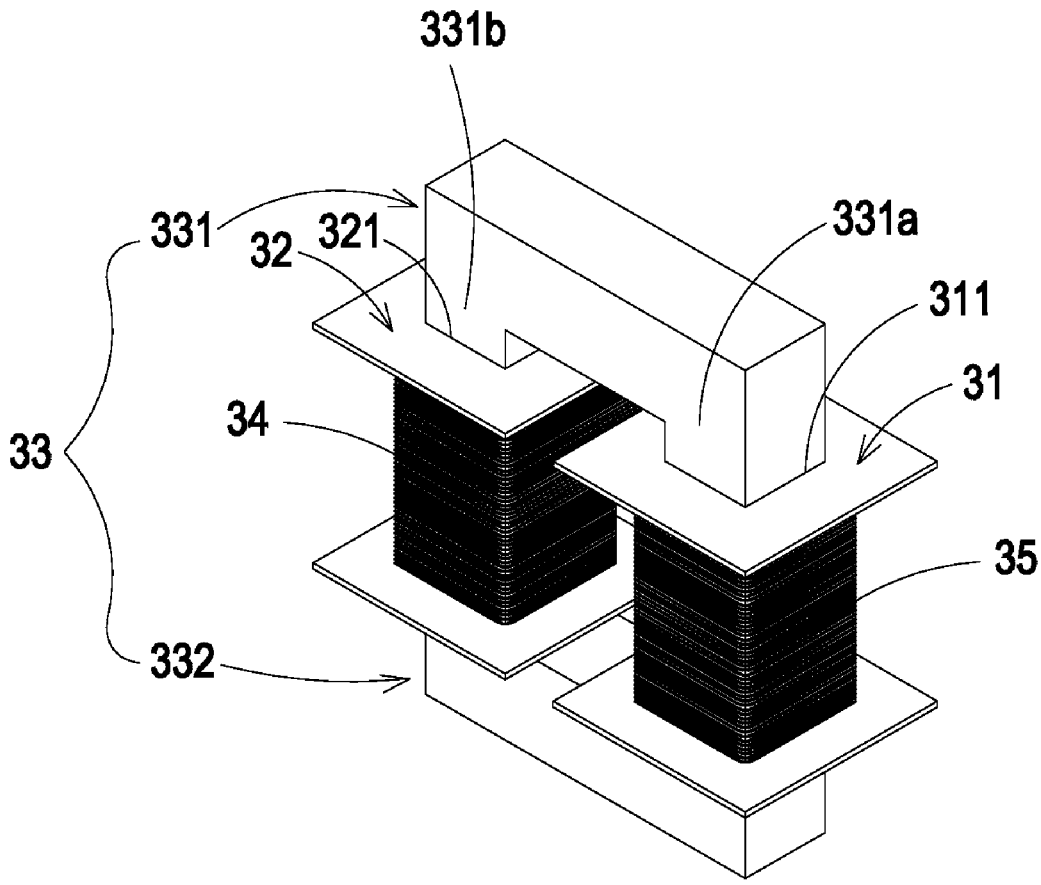
FIG. 3 is a schematic assembled view of a transformer according to a second embodiment of the present invention.

FIG. 3 is a schematic assembled view of a transformer according to a second embodiment of the present invention. As shown in FIG. 3, the transformer 3 comprises a first base 31, a second base 32, a magnetic core assembly 33, a first winding coil assembly 34 and a second winding coil assembly 35. The configurations of the first base 31 and the second base 32 are identical to those of the base shown in FIG. 2, and are not redundantly described herein. In this embodiment, the magnetic core assembly 33 is a UU-type core assembly. The magnetic core assembly 33 comprises the first magnetic part 331, the second magnetic part 332 and multiple third magnetic parts (not shown). A first lateral post 331*a* of the first magnetic part 331 is accommodated within a first receptacle 311 of the first base 31. A second lateral post 331*b* of the first magnetic part 331 is accommodated within a first receptacle 321 of the second base 32. Similarly, the two lateral posts of the second magnetic part 332 are accommodated within the second receptacles (not shown) of the first base 31 and the base 32. By means of the first base 31 and the second base 32, the first magnetic part 331 and the second magnetic part 332 of the magnetic core assembly 33 are assembled with each other. The third magnetic parts could be accommodated with respective receiving recesses of the first base 31 and the base 32. The number of the third magnetic parts could be varied according to the practical requirements. According to the number of the third magnetic parts and the distribution of the third magnetic parts, the air gap of the magnetic core assembly 33 of the transformer 3 is adjustable.

Figure 4:
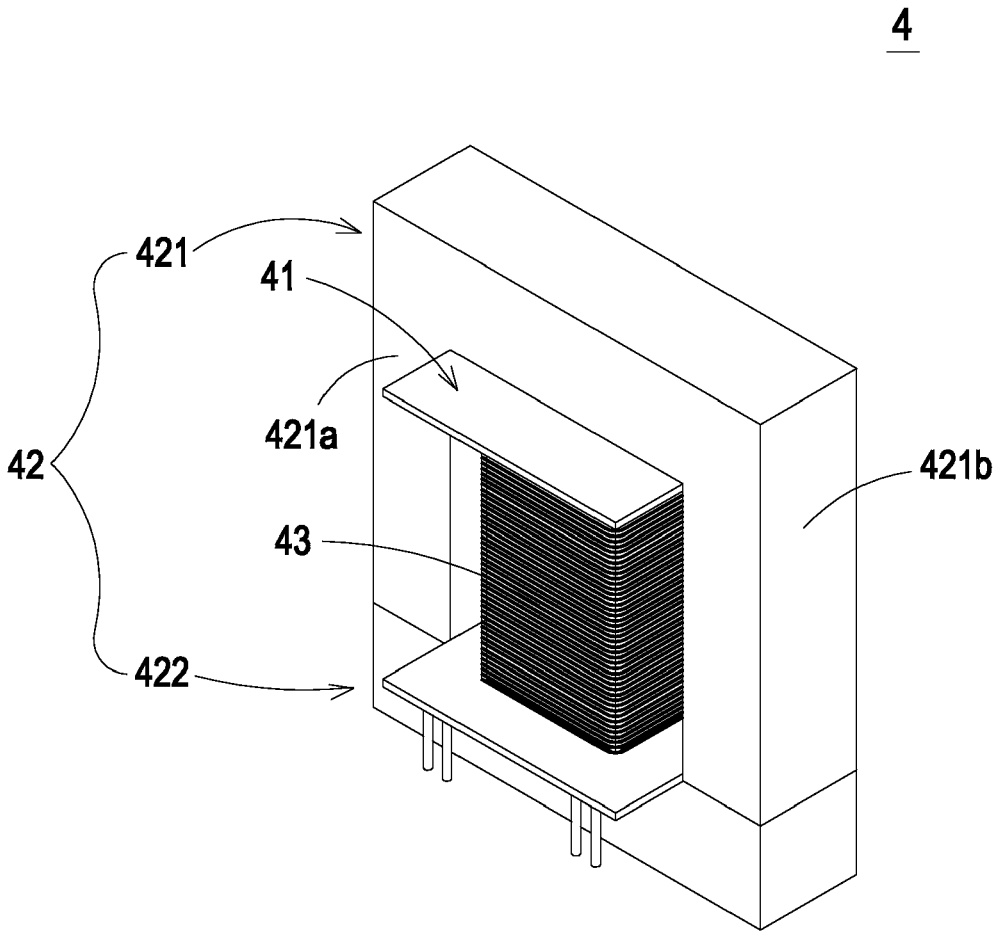
FIG. 4 is a schematic assembled view of a transformer according to a third embodiment of the present invention.

FIG. 4 is a schematic assembled view of a transformer according to a third embodiment of the present invention. As shown in FIG. 4, the transformer 4 comprises a base 41, a magnetic core assembly 42 and at least one winding coil assembly 43. The configurations and the relative locations of the base 41 and the winding coil assembly 43 are identical to those of the first embodiment, and are not redundantly described herein. The magnetic core assembly 42 comprises the first magnetic part 421, the second magnetic part 422 and multiple third magnetic parts (not shown). In this embodiment, the magnetic core assembly 42 is an EI-type core assembly. For example, the first magnetic part 421 is an E-type core, and the second magnetic part 422 is an I-type core. The first post is a middle post of the first magnetic part 421. The middle post of the first magnetic part 421 is accommodated within the first receptacle (not shown) of the first base 41. The length of each of the lateral posts 421*a* and 421*b* of the first magnetic part 421 is substantially equal to the length of the base 41. After the first magnetic part 421 is combined with the base 41, both sides of the base 41 are respectively shielded by the lateral posts 421*a* and 421*b* of the first magnetic part 421. The second magnetic part 422 is disposed under the first magnetic part 421 and the base 41. The first magnetic part 421 is fixed on the second magnetic part 422 by an insulating tape or a clamping tool (not shown). Meanwhile, the transformer 4 is assembled. The winding coil assembly 43 will interact with the first magnetic part 421, the second magnetic part 422 and the third magnetic parts to achieve the purpose of voltage regulation. The number of the third magnetic parts could be varied according to the practical requirements. According to the number of the third magnetic parts and the distribution of the third magnetic parts, the air gap of the magnetic core assembly 42 of the transformer 4 is adjustable.

In the above embodiments, the first magnetic part and the second magnetic part of the magnetic core assembly are collectively formed as an EE-type core assembly, a UU-type core assembly or an EI-type core assembly. The number, the shapes and the locations of the third magnetic parts could be varied according to the practical requirements. As such, the designs of the base and the magnetic core assembly become diversified and the utilization flexibility of the transformer is enhanced.

From the above description, the transformer of the present invention comprises a base, a magnetic core assembly and at least one winding coil assembly. The base has a first receptacle and at least one receiving recess. The magnetic core assembly comprises a first magnetic part, a second magnetic part and at least one third magnetic part. The first post of the first magnetic part is accommodated within the first receptacle and inserted into the first receptacle 212 in a first direction. The at least one third magnetic part is accommodated within the at least one recessing recess and aligned with the first middle post 221*a* of the first magnetic part 221. By changing the number and/or the location of the third magnetic part, the air gap between the third magnetic part and the first magnetic part/the second magnetic part is adjustable in a direction parallel to the first direction. As a consequence, the eddy loss and the operating temperature are reduced. Moreover, the inductance of the transformer is adjustable by changing the number and/or the location of the third magnetic part. In addition, the magnetic core assembly and the base of the transformer could be standardized, so that the fabricating cost and time are reduced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A transformer comprising:

a base comprising a first receptacle and at least one first receiving recess;

a magnetic core assembly comprising a first magnetic part, a second magnetic part and a third magnetic part, wherein said base is arranged between said first magnetic part and said second magnetic part, and said first magnetic part has a first post accommodated within said first receptacle and inserted into said first receptacle in a first direction; and at least one winding coil assembly disposed on said base, wherein said third magnetic part is accommodated within said first receiving recess and aligned with said first post of the said first magnetic part, so that an air gap between said third magnetic part and said first magnetic part or said second magnetic part is adjustable in a direction parallel to said first direction.

2. The transformer according to claim 1 wherein the dimension of said third magnetic part is identical to that of said first receiving recess.

3. The transformer according to claim 1 wherein said base further comprises a second receptacle for accommodating a second post of said second magnetic part.

4. The transformer according to claim 3 wherein said first receptacle is formed in a first surface of said base, and said first receiving recess is formed in a second surface of said base, wherein said first surface is perpendicular to said second surface.

5. The transformer according to claim 4 wherein said second receptacle is formed in a third surface of said base, wherein said third surface is parallel to said first surface.

6. The transformer according to claim 4 wherein said base further comprises at least one second receiving recess for accommodating said third magnetic part.

7. The transformer according to claim 6 wherein said second receiving recess is formed in a fourth surface of said base, wherein said fourth surface is perpendicular to said first surface.

8. The transformer according to claim 1 wherein said magnetic core assembly is an EE-type core assembly, a UU-type core assembly or an EI-type core assembly.

9. The transformer according to claim 1 wherein said first post is integrally formed with said first magnetic part.

10. The transformer according to claim 1 wherein said first post is a first middle post of said first magnetic part, and said first middle post is shorter than each of multiple lateral posts of said first magnetic part.

11. The transformer according to claim 1 wherein said first post is a lateral post of said first magnetic part.

12. A transformer comprising:

a base comprising a first receptacle and multiple first receiving recesses, wherein said first receiving recesses are distributed in different locations of said base;

a magnetic core assembly comprising a first magnetic part, a second magnetic part and multiple third magnetic parts, wherein said base is arranged between said first magnetic part and said second magnetic part, and said first magnetic part has a first post accommodated within said first receptacle and inserted into said first receptacle in a first direction; and at least one winding coil assembly disposed on said base, wherein at least one of said third magnetic parts is accommodated within respective first receiving recess and aligned with said first post of said first magnetic part, so that an air gap between said third magnetic part and said first magnetic part or said second magnetic part is adjustable in a direction parallel to said first direction.

* * * * *